US006527541B2

(12) United States Patent
Lochschmied

(10) Patent No.: US 6,527,541 B2
(45) Date of Patent: Mar. 4, 2003

(54) REGULATING DEVICE FOR AN AIR RATIO-REGULATED BURNER

(75) Inventor: Rainer Lochschmied, Rheinstetten (DE)

(73) Assignee: Siemens Building Technologies AG, Zurich (CH)

( * ) Notice: Subject to any disclaimer, the term of this patent is extended or adjusted under 35 U.S.C. 154(b) by 0 days.

(21) Appl. No.: 09/939,002

(22) Filed: Aug. 24, 2001

(65) Prior Publication Data

US 2002/0048737 A1 Apr. 25, 2002

(30) Foreign Application Priority Data

Sep. 5, 2000 (DE) ..... 100 44 633

(51) Int. Cl.[7] ..... F23N 1/00
(52) U.S. Cl. ..... 431/25; 431/26; 431/78
(58) Field of Search ..... 431/25, 26, 66, 431/75, 78

(56) References Cited

U.S. PATENT DOCUMENTS

| | | | | |
|---|---|---|---|---|
| 4,436,505 A | | 3/1984 | Yamaguchi et al. | |
| 5,253,475 A | * | 10/1993 | Kabasin | 431/66 |
| 5,658,140 A | * | 8/1997 | Kondou et al. | 431/31 |
| 5,899,683 A | * | 5/1999 | Nolte et al. | 431/12 |
| 5,919,035 A | * | 7/1999 | Iwama et al. | 126/116 R |
| 5,924,859 A | * | 7/1999 | Nolte et al. | 431/12 |
| 5,971,745 A | * | 10/1999 | Bassett et al. | 431/12 |
| 5,984,663 A | * | 11/1999 | Joyce | 126/86 |

FOREIGN PATENT DOCUMENTS

DE 196 18 573 6/1997

* cited by examiner

*Primary Examiner*—Henry Bennett
*Assistant Examiner*—Alfred Basichas
(74) *Attorney, Agent, or Firm*—Greer, Burns & Crain, Ltd.

(57) ABSTRACT

During start-up a regulating device monitors the quality of the air ratio control in respect of time in accordance with the invention in that it observes the difference of a signal and comparison signal.

8 Claims, 3 Drawing Sheets

REGULATING DEVICE FOR AN AIR RATIO-REGULATED BURNER

BACKGROUND OF THE INVENTION

1. Field of the Invention

The invention relates to a regulating device.

2. Description of the Prior Art

In a burner the ratio of the amount of air to the amount of fuel, referred to as the air ratio or lambda, must be matched to each other throughout the entire output range either by a control arrangement or by a regulating arrangement. In general terms lambda should be slightly above the stoichiometric value of 1, for example 1.3.

Air ratio-regulated burners, unlike controlled burners, react to external influences which alter combustion. For example, combustion can be re-regulated after a change in the kind of fuel or the density of the air. They have a higher level of efficiency and thus a higher degree of effectiveness as well as lower levels of pollutant and soot emissions. Environmental pollution is less and the service life is increased.

Regulation of the air ratio is particularly effective if the quality of combustion can be observed with a sensor. Typically, known burners use oxygen sensors in the flue gas duct, temperature sensors on the burner surface or UV-sensors in the combustion chamber. More recent developments are based on the ionisation electrode which has already long been used as standard for monitoring the flame in burners.

Air ratio-regulated burners which use an ionisation electrode as the flame sensor are known from German patent specification No 196 18 573. Such burners monitor the regulating circuit inter alia by a procedure whereby the measurement signal should not depart from a safety margin around the reference regulating value during the regulating operation, for a long period. If however that is the case, the burner shuts down.

It is at least less meaningful for the air ratio to be regulated immediately after the burner fires up as the ionisation signal is only representative of combustion in the thermally steady-state condition. Therefore the ratio of air and fuel is initially controlled, for example during the first minute after the burner comes into operation. It is only thereafter that it is subjected to precise correctional regulation.

It is further known that, during the firing operation, the air ratio is varied so that it is possible to find a mixture which is good for the kind of fuel supplied. In the further starting operation the burner is controlled on the basis of that air ratio value. An example thereof is also described in German patent specification No 196 18 573. During the firing operation such a burner raises the gas proportion with a fixed volume flow of air until the ionisation electrode detects a flame. The start-up control retains the gas valve position corresponding to firing, although the gas-air mixture is typically somewhat too rich. It is only after the system has reached its operating temperature that it is switched over to regulation by means of an ionisation signal.

Besides the burner starting characteristics, it is conceivable that at a later time, for other reasons, the ionisation signal is not representative of combustion or the regulating circuit becomes unstable due to external influences. In that case also the regulation can be temporarily shut down and the air ratio can be controlled during that time.

The control period should be as short as possible as external influences cannot be the subject of correctional regulation during that time. In addition, the quality of the control action under the specific circumstances involved should be monitored at least marginally and for plausibility. If the position of the fuel valve or the air blower is not monitored by additional measures during the control period, then in the event of a defect the permissible emission values can be severely exceeded.

SUMMARY OF THE INVENTION

The object of the present invention is to improve quality monitoring during such control periods in an inexpensive and simple fashion.

In accordance with the present invention, there is provided a regulating device for an air ratio-regulated burner, which burner is equipped with

- a sensor which detects the quality of combustion, and
- a setting member which influences the feed amount of fuel or the feed amount of air in dependence on a setting signal, which regulating device is equipped with

- a sensor evaluating device which is connectable downstream of the sensor and which produces a sensor signal,
- a control unit in which characteristic data for determining at least one mode of behaviour of the setting member are stored and which at least at times produces at least one control signal, and
- a regulator which produces the setting signal during at least one control period in dependence on the control signal and not in dependence on the sensor signal and otherwise in dependence on the sensor signal, wherein
- at least at times during the control period the regulator produces a comparison signal in dependence on the sensor signal,
- the regulating device establishes the difference between the comparison signal and a corresponding signal, and
- the regulating device can produce a fault signal in dependence on the difference.

Advantageous aspects of the invention are set forth in the dependent claims.

BRIEF DESCRIPTION OF THE DRAWINGS

An embodiment of the invention is described in greater detail hereinafter with reference to the drawings in which.

DESCRIPTION OF THE PREFERRED EMBODIMENTS

Figure 1:
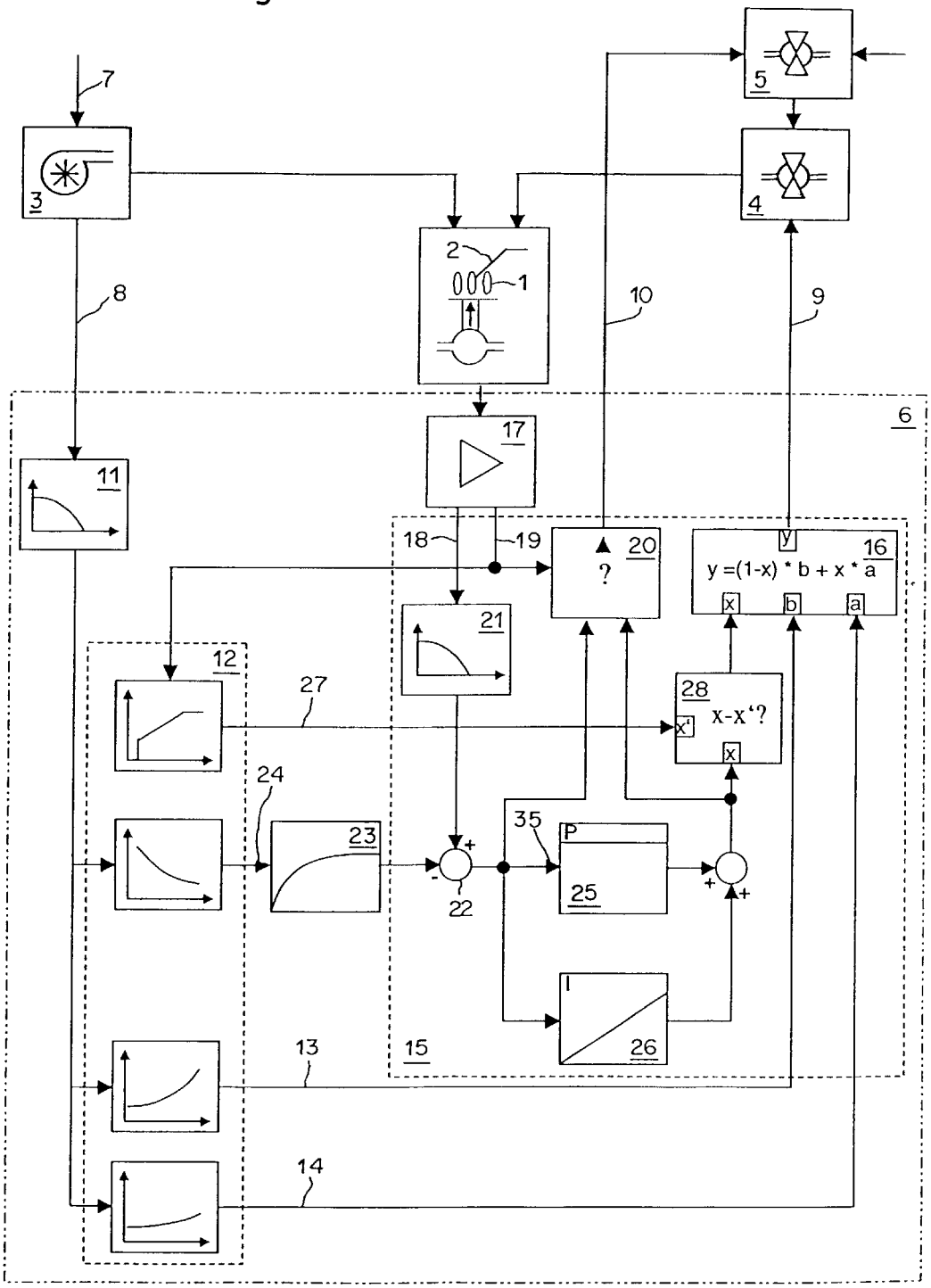
FIG. 1 shows a block circuit diagram of a regulating device according to the invention.

In FIG. 1 reference 1 denotes the flame of an air ratio-controlled gas burner. An ionisation electrode 2 projects into the region of the flame 1. The flame 1 is fed by a settable air blower 3 and a settable gas valve 4. A safety valve 5 in the gas feed provides for fail-safe shut-down in the event of a defect message.

Instead of an air blower, in many atmospheric burners the air is supplied by the burner draw and can be controlled by a settable air flap.

A regulating device 6 sets the air blower 3, the gas valve 4 and the safety valve 5 as follows.

The setting member of the air blower 3 is actuated by an output demand signal 7 to a rotary speed corresponding to a rotary speed signal 8 which is used as an input parameter for the output demand.

It will be appreciated that it is also possible to use another parameter, for example the measurement signal of a differential pressure measuring device in the ventilation duct, as the output parameter.

The settable gas valve 4 is driven by a setting signal 9 by way of a motor (not shown). A mechanical pressure regulator (not shown) is interposed.

The safety valve 5 is opened against spring pressure as long as an enable signal 10 is applied.

In normal operation the air ratio is regulated by way of the ionisation electrode 2. Matching of the setting signal 9 to the rotary speed signal 8 is effected by observing current and voltage at the ionisation electrode 2 as a measurement of flame quality.

The rotary speed signal 8 is passed by way of a filter 11 to a control unit 12 which is embodied in the form of a program portion in a microprocessor. Stored there are characteristic data which establish the characteristic curves of a first and a second control signal 13 and 14 respectively. Those characteristic curves represents for each rotary speed a value of the setting signal 9 which is wanted under their respective circumstances, in this case for two kinds of gas with different specific energy values. The control signals 13, 14 are fed to a regulator 15 where, on the basis of the flame quality, in a setting module 16, they are weighted and added up in order to form the setting signal 9. The regulator 15 is embodied in the form of a program portion in a microprocessor.

The quality and presence of the flame 1 is firstly ascertained by the ionisation electrode 2. A sensor evaluating device 17 prepares two signals therefrom. A sensor signal 18 is a measurement in respect of the quality of the flame. A monitoring signal 19 communicates extinction of the flame 1 to a monitoring unit 20 in the regulator 15.

The monitoring unit 20 interrupts the enable signal 10 in response to a corresponding monitoring signal and thereby closes the safety valve 5. As a result the supply of gas ceases.

The sensor signal 18 is also fed to the regulator 15. There it is firstly smoothed by means of a low pass filter 21 in order to suppress interference pulses and flicker. In a comparison unit 22 a reference value signal 24 produced by the control unit 12 and passed by way of a correction unit 23 is subtracted. The reference value signal 24 represents by way of a characteristic curve in relation to each rotary speed a desired value of the sensor signal 18. A proportional regulator 25 and a parallel integrating unit 26 freshly ascertain from the difference the internal regulating value x which freshly weights the two control signals 13 and 14 and thus alters the setting signal 9.

It will be appreciated that the regulating value x can alternatively be produced by other types of regulator, for example a PID-regulator or a state regulator.

In normal operation therefore the sensor signal 18 is regulated to its reference value which is associated with the current output and combustion acquires the quality which is set by way of the reference value signal 24.

On the other hand the air ratio is controlled in a programmed mode during a starting operation until the burner and the ionisation electrode 2 have approached or reached their operating temperature. It is only thereafter that the normal operating mode follows, involving regulation of the air ratio.

The reason for control at the start lies inter alia in the inertia of the sensor which measures the quality of combustion.

It is not just ionisation electrodes moreover that involve such a delay. Depending on the respective burner involved an ionisation signal can only be used about 30 s after firing, for regulating purposes. Other sensors such as for example $ZrO_2$-oxygen sensors in the flue duct, depending on the respective structure involved, require more than a minute before reliable regulating signals can be obtained.

During a starting operation the control unit 12 produces a start-up signal 27 which is fed to the regulator 15 and causes it to produce a setting signal 9 which increases linearly with time. A switching unit 28 selects the start-up signal 27, instead of the regulating value x, for that long. Because however the air blower 3 produces a uniform air flow, the air ratio becomes progressively smaller from initially high values. As soon as the mixture of air and gas is sufficiently rich, ignition of the flame 1 can take place.

Figure 2:
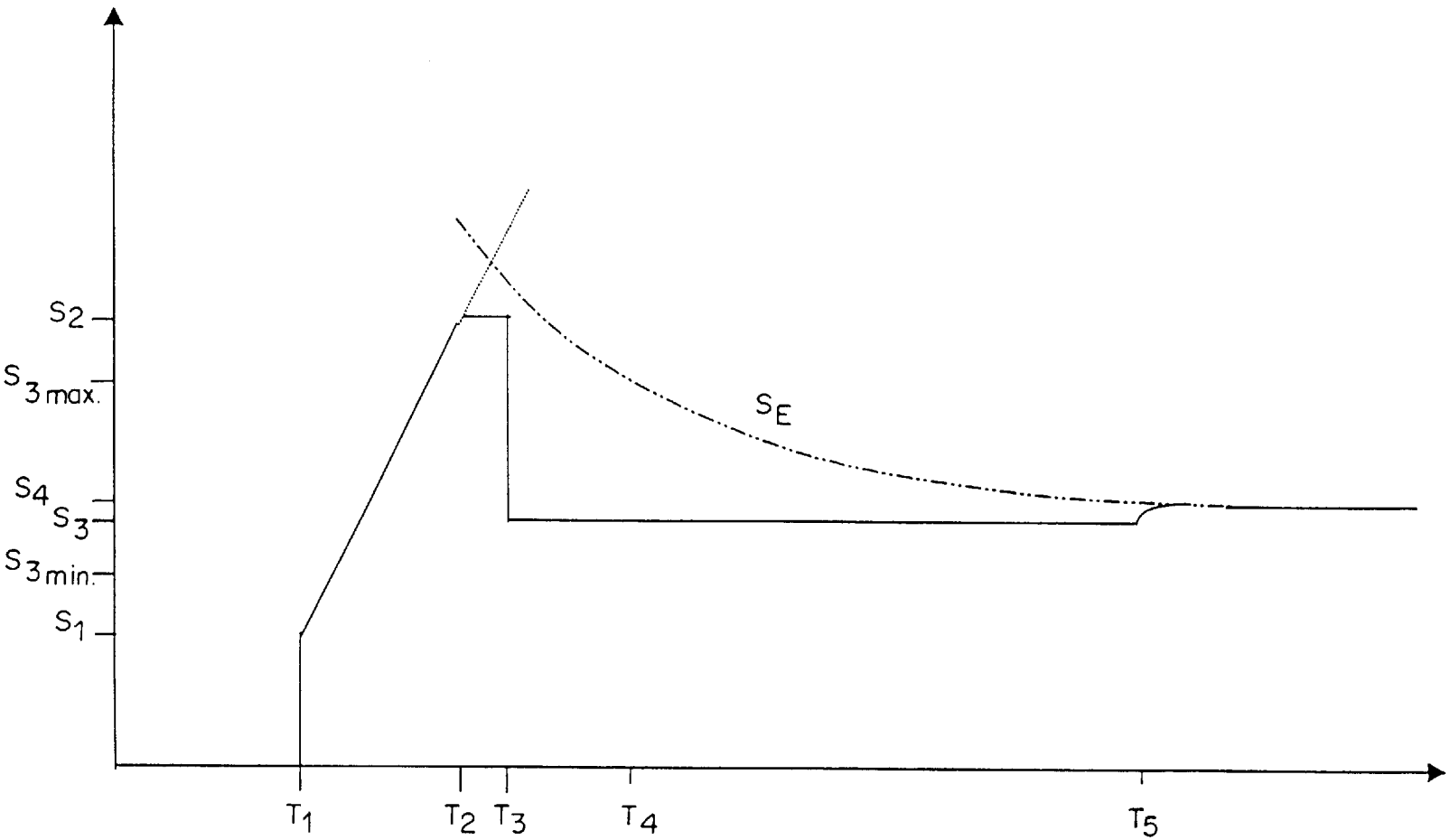
FIG. 2 shows the operating procedure in respect of time involved in starting up the burner with the regulating device.

The configuration in relation to time of the setting signal 9 for the gas valve 4 during a starting procedure is diagrammatically shown in FIG. 2. An output demand occurs at time t=0.

After a possibly programmed pre-scavenge time the air blower 3 must be accelerated at the time $t_1$ to a fixed firing rotary speed so that combustion air is present. A firing device already begins to periodically produce firing pulses.

Gas must also be present at the time T1. For that purpose, by means of the enable signal 10 the regulator 15 opens the safety valve 5 and produces a setting signal 9 which sets the position of the gas valve 4 to its starting position $S_1$.

To determine the starting position $S_1$ the control unit 12 feeds a start-up signal 27 to the regulator 15. In that phase the start-up signal 27 determines a control value x' as a provisional substitute for the regulating value x in regard to weighting of the two control signals 13 and 14. The value thereof is fixed for the above-mentioned firing rotary speed of the air blower 3. The regulator 15 weights the control signals 13 and 14 on the basis of the start-up signal so that a setting signal 9 corresponding to the starting position $S_1$ appears at the output of the regulator.

Immediately after the time T1 the control unit 12 in the above-specified manner increases the setting signal 9 in accordance with a programmed procedure, with the amount of gas being linearly increased per unit of time. The gas-air mixture is initially very lean and becomes progressively richer during the firing operation until firing takes place at the time $T_2$.

As soon as the monitoring signal 19 confirms the presence of the flame 1 the linear rise in the setting signal 9 is stopped and the position of the gas valve 4 is kept constant at its firing position $S_2$. Then, on the basis of the firing position $S_2$ and the required firing time $T_2=T_1$, the control unit 12 can estimate the gas range and re-selects the control value x' so that it matches the estimated gas range. Depending on the respective kind of gas involved the new control value x' is for example 0.9 or 0.1. That results in re-setting of the gas valve 4 to a correction position $S_3$.

The setting signal 9 in FIG. 2 is therefore rapidly corrected at time $T_3$ to the correction position $S_3$.

It will be appreciated that it would be possible to adopt a fixed firing position for the gas valve 4, as an alternative to the above-described starting ramp. In that case, the control value x' for the control phase after firing would be predetermined as a programmed value or would be ascertained as a learnt value from the last cessation of operation and stored.

FIG. 2 also shows a dash-dotted curve which represents the setting signal 9 if it is calculated on the basis of the sensor signal 18. That notional setting signal $S_E$ would therefore be the setting signal 9 if the regulating circuit is not opened during a starting operation.

It will be appreciated that for that purpose, by means of an analog circuit or a program portion, the monitoring unit 20 must approximately simulate the behaviour of the flame in response to the notional setting signal $S_E$ and so set the notional setting signal $S_E$ that the instantaneous measurement value of the ionisation signal 18 is produced.

For reasons set out hereinbefore in this phase the notional setting signal $S_E$ is not suitable for permitting regulation. It has been found nonetheless that the notional setting signal $S_E$ comes so very close to the subsequently optimally regulated value relatively rapidly, for example just 2 seconds after opening of the gas valve 4, that it forms a reliable comparison means for distinguishing serious faults from harmless inaccuracies in the control.

As from a time $T_4$ to the end of the control period at the time $T_5$ the monitoring unit 20 continuously checks whether the notional setting signal $S_E$ or the associated regulating value $X_E$ is within a limit range around the actual setting signal 9. The limits are identified in FIG. 2 by $S_{3min}$ and $S_{3max}$ and are for example of the values of 0.90 times $S_3$ and 1.25 times $S_3$.

In actual fact moreover the monitoring unit 20 checks the otherwise unused regulating value x by comparing it to the control value x'. That comparison is equivalent to a comparison between the notional setting signal $S_E$ and the setting signal 9. The difference is only previous or subsequent processing by the setting module 16.

As soon as the notional setting signal $S_E$ leaves the stated limit range the monitoring signal 20 produces a fault signal (not shown) and cuts out the enable signal 10 so that the safety valve 5 is closed.

The regulating device 6 stores the detection of a fault signal in an EEPROM so that the event can be recognised again after a possible failure in the supply current. An unlocking signal (not shown) by the burner operator can cancel the consequences of an earlier fault signal.

In an alternative the monitoring unit 20 only shuts down combustion when the notional setting signal $S_E$ has left the limit range for a predetermined period of time. Likewise monitoring does not necessarily have to be continuous but could also be effected in a discrete procedure at one or more fixed moments in time.

After the attainment of a lower difference between the notional setting signal $S_E$ and $S_3$ the control period is terminated and the interrelationship of air and gas is regulated on the basis of the sensor signal 18.

It will be appreciated that the end of the control period at the time $T_5$ could also be pre-programmed.

After the time $T_5$ production of the setting signal 9 is taken over by processing of the sensor signal 18. The setting signal 9 rapidly adjusts to its regulating value $S_4$.

Alternatively the output of the burner during the control period can be set to another value in the entire permissible range.

FIG. 1 also shows that alternatively the monitoring unit 20 processes the ionisation signal 18 instead of the setting signal 9 or the regulating value x. In that case it is compared to a reference value signal 24 and may not leave for example a pre-programmed limit range which can also be time-dependent. Sole use of that alternative would permit the monitoring unit 20 to be of a very simple design configuration. A comparison signal is present in any case in the form of the reference value signal 24 and the comparison is already fed to the monitoring unit 20 by the comparison unit 22 in the form of the difference signal 35.

Figure 3:
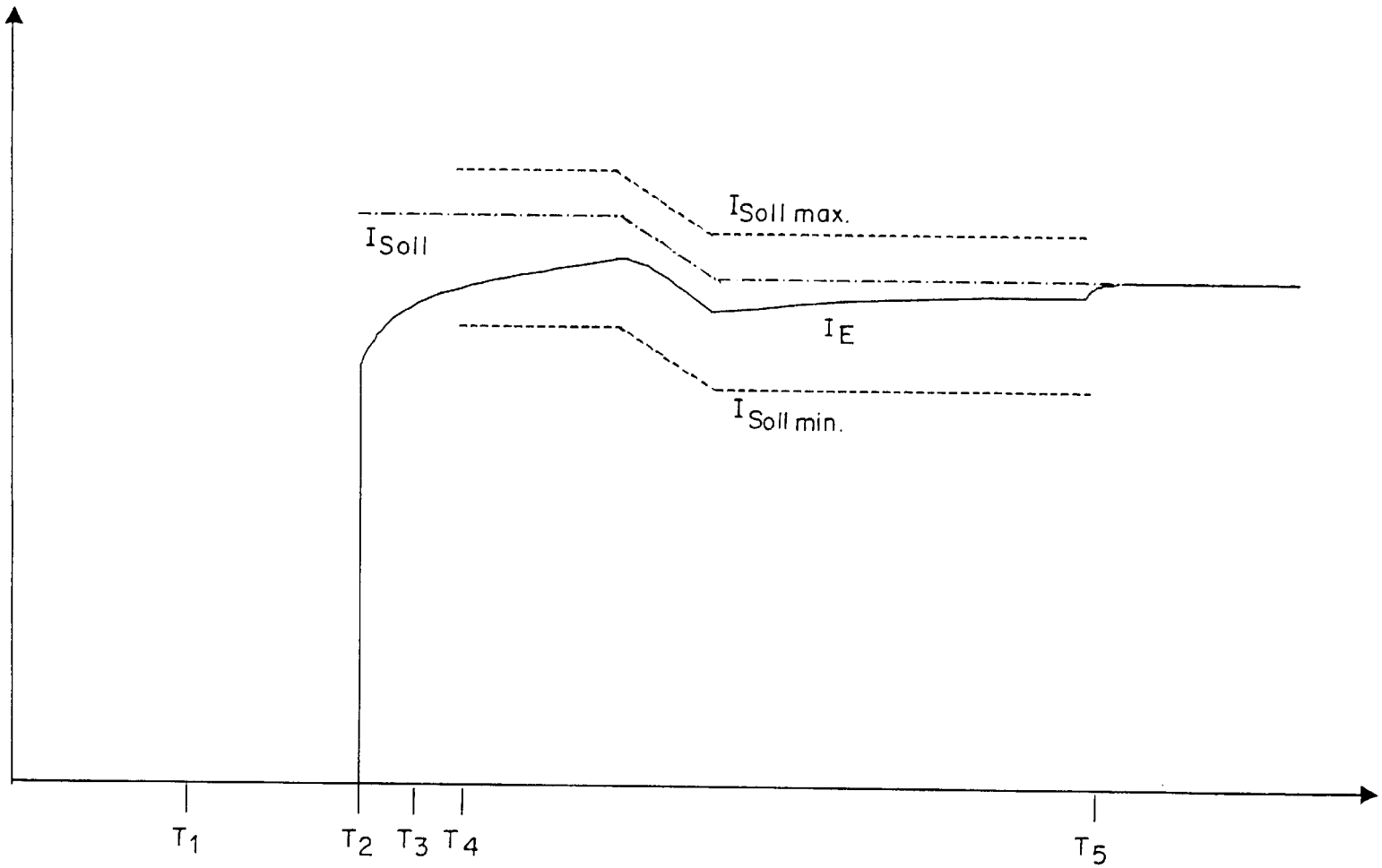
FIG. 3 shows an alternative operating procedure in respect of time involved in starting up the burner with the regulating device.

FIG. 3 illustrates this alternative in greater detail. The variation in respect of time of the ionisation signal 18 during a starting operation is identified as a dash-dotted curve $I_E$. The value of the reference value signal 24 is indicated by $I_{SOLL}$.

At the time $T_4$, shortly after the time $T_3$ or even at the same time, monitoring begins. The monitoring unit 20 checks continuously or at discrete moments in time whether the ionisation signal $I_E$ does not leave its limit values which are identified as $I_{SOLLmin}$ and $I_{SOLLmax}$.

The regulating procedure on the basis of the ionisation signal 18 begins at the time $T_5$.

I claim:

1. A regulating device for an air ratio-regulated burner, which burner is equipped with a sensor which detects the quality of combustion, and a setting member which influences the feed amount of fuel or the feed amount of air in dependence on a setting signal, which regulating device is equipped with a sensor evaluating device which is connectable downstream of the sensor and which produces a sensor signal, a control unit in which characteristic data for determining at least one mode of behaviour of the setting member are stored and which at least at times produces at least one control signal, and a regulator which produces the setting signal during at least one control period in dependence on the control signal and not in dependence on the sensor signal and otherwise in dependence on the sensor signal, wherein at least at times during the control period the regulator produces a comparison signal in dependence on the sensor signal, the regulating device establishes the difference between the comparison signal and a corresponding signal, and the regulating device can produce a fault signal in dependence on the difference.

2. A regulating device according to claim 1 wherein the sensor is an ionisation electrode arranged in the flame region of the burner.

3. A regulating device according to claim 2 wherein the regulating device has time detection, and the regulating device can produce a fault signal at the earliest as from 2 seconds after the beginning of the control period.

4. A regulating device according to claim 1 wherein a positive limit value and a negative limit value are stored in the regulating device, and the regulating device produces a fault signal if the difference has exceeded a positive limit value or has fallen below a negative limit value.

5. A regulating device according to claim 4 wherein the regulating device produces a fault signal immediately after the difference has exceeded the positive limit value or has fallen below the negative limit value.

6. A regulating device according to claim 4 wherein the positive limit value is up to +30% of the value of the corresponding signal and the negative limit value is up to −13% of said value.

7. A regulating device according to claim 1 wherein upon firing of the burner the control unit causes the regulator to produce the setting signal such that the air ratio goes from sub-stoichiometric to over-stoichiometric, the regulating device estimates the specific energy content of the fuel from the behaviour of the setting member upon flame ignition, and the control unit causes the regulator to produce a corresponding setting signal after firing of the burner.

8. A regulating device according to claim 1 wherein at least once during a regulating period the regulating device ascertains the magnitude of the setting signal which is suitable during the control period and stores it in the control unit, and after firing of the burner the control unit causes the regulator to produce a corresponding setting signal.

* * * * *